United States Patent [19]

Reed

[11] Patent Number: 4,836,484

[45] Date of Patent: Jun. 6, 1989

[54] WALL BRACKET ASSEMBLY

[76] Inventor: Robert H. Reed, 25557 Snyder Ave., Conifer, Colo. 80433

[21] Appl. No.: 177,377

[22] Filed: Apr. 4, 1988

[51] Int. Cl.[4] ..... A47G 29/02

[52] U.S. Cl. ..... 248/243; 108/107; 108/110

[58] Field of Search ..... 248/125, 235, 239, 243, 248/247; 211/187, 208; 108/110, 107, 106

[56] References Cited

U.S. PATENT DOCUMENTS

| | | | |
|---|---|---|---|
| 538,958 | 5/1895 | Fletcher . | |
| 693,127 | 2/1902 | Gardner | 248/243 |
| 2,056,078 | 9/1936 | Slater | 248/243 |
| 2,872,144 | 2/1959 | Hobson | 248/223 |
| 2,933,196 | 4/1960 | Childs | 248/243 |
| 3,193,885 | 7/1965 | Gartner et al. | 20/4 |
| 3,265,344 | 8/1966 | Ornstein | 248/243 |
| 3,574,980 | 4/1971 | Keller | 52/36 |
| 3,652,048 | 3/1972 | Hartman | 248/243 |
| 4,086,858 | 5/1978 | Howitt | 108/110 |
| 4,183,487 | 1/1980 | Swain | 248/243 |

FOREIGN PATENT DOCUMENTS

| | | | |
|---|---|---|---|
| 486322 | 10/1929 | Fed. Rep. of Germany | 248/243 |
| 945260 | 11/1948 | France | 248/243 |
| 155268 | 7/1956 | Sweden . | |
| 202774 | 6/1965 | Sweden | 211/187 |

*Primary Examiner*—J. Franklin Foss
*Assistant Examiner*—Robert A. Olson
*Attorney, Agent, or Firm*—John E. Reilly

[57] ABSTRACT

A wall bracket assembly is made up of spaced standards attachable to a wall and each standard provided with vertically spaced bores for insertion of a support pin angled away from a bracket member. Each support pin serves the additional purpose of rigidly joining together horizontal and vertical portions of each wall bracket by engaging a cross pin through the joint. The bracket and wall have cooperating detail and coping which interfit together when the support pin is inserted into one of the openings so as to resist any sideways turning or shifting of the bracket with respect to the standard.

8 Claims, 1 Drawing Sheet

WALL BRACKET ASSEMBLY

This invention relates to bracket assemblies; and more particularly relates to a novel and improved wooden wall bracket assembly in which one or more brackets may be adjustably supported on standards affixed to a wall in spaced relation to one another to support a shelf or other articles.

BACKGROUND AND FIELD OF THE INVENTION

Numerous types of adjustable bracket supports have been devised for wall or shelf bracket assemblies and for the purpose of display or other suitable uses. Generally speaking, wooden wall brackets are more attractive than metal ones in present day use but in the past have not been considered to be quite as versatile or of sufficient strength to support heavy objects.

Of the numerous approaches taken in the past to construction of a rugged but versatile wall bracket assembly, U.S. Pat. No. 3,574,980 to J. R. Keller perhaps best typifies the approach of utilizing vertical supports and brackets with coping and detail between each bracket and support. Keller requires the use of wood screws which angle downwardly from the bracket into the support at a relatively low gradual angle. Similarly, U.S. Pat. No. 3,652,048 to L. Hartman illustrates the utilization of a vertical channel in a standard for wall bracket assembly for adjustably mounting and supporting wall brackets in vertically spaced relation to one another. Nevertheless, it is proposed in accordance with the present invention to devise a completely wooden wall bracket construction which simplifies the interconnection between standards and wall brackets, permits completely wooden construction of elements throughout with a minimum number of parts and which parts interfit together to provide for a more rugged and secure construction than those previously devised or available.

SUMMARY OF THE INVENTION

It is therefore an object of the present invention to provide for a novel and improved wall bracket assembly.

Another object of the present invention is to devise a wall bracket assembly which is particularly well-suited to be constructed of wooden parts in which the necessary supporting means for adjustably supporting the brackets in place on wall standards are hidden once interconnected together and with rugged and secure interfitting relationship between the parts.

A further object of the present invention is to provide for a novel and improved shelf panel comprising a combination of wooden standards and wall brackets in which the wall brackets are interconnected by support pins which also serve to adjustably support the brackets in desired spaced relation to the standards and in such a way as to essentially integrate the brackets to the standards in a novel and improved manner.

It is an additional object of the present invention to provide for a shelf bracket assembly as hereinbefore described which is comprised of a minimum number of parts which can be quickly and securely interfitted together into a selected one of a plurality of vertically spaced locations along a standard and where the bracket members are readily releasable or adjustable to different locations when desired to modify the spacing or mounting of the bracket in a particular location.

In accordance with the present invention, a preferred form of wall bracket assembly comprises in combination a pair of horizontally spaced standards provided with vertically spaced openings therein and fastener means for fastening the standards in predetermined spaced relation to one another on a common wall surface. At least one wall bracket is provided for each standard, each bracket having a vertically extending bracket portion with a vertical edge engaging the standard and a first upper connecting end, and a horizontally extending bracket portion has an upper shelf support surface and a second connecting end which is complementary to the first connecting end with securing means interconnecting the ends rigidly together such that the horizontal bracket portion is in predetermined, fixed relation to the vertical bracket portion. Preferably, the bracket assembly is of completely wooden construction with detail and coping between the interfitting edges of each standard and vertical edge of each bracket portion so that the securing means when inserted into one of the openings in a standard will cause a vertical grooved edge of the bracket to receive a coping portion on the standard to prevent twisting of the bracket with respect to the standard. In this respect, preferably the securing means has a combination of a cross pin and a downwardly and rearwardly extending dowel pin, the latter projecting away from the vertical edge portion of the bracket for insertion into one of the openings on the standard.

The above and other objects, advantages and features of the present invention will become more readily understood and appreciated from a consideration of the following detailed description of a preferred embodiment of the present invention when taken together with the accompanying drawings in which:

DETAILED DESCRIPTION OF THE PREFERRED EMBODIMENT

Referring in more detail to the drawings, a preferred form of wall bracket assembly broadly comprises a standard 10 and bracket 12. As such, the standard 10 and bracket 12 make up one side a complete wall bracket assembly in which one or more corresponding standards and brackets, not shown, are horizontally spaced from the first standard 10 and bracket 12 so that a common shelf as illustrated at S may be supported by the brackets to extend for the desired length.

Figure 1:
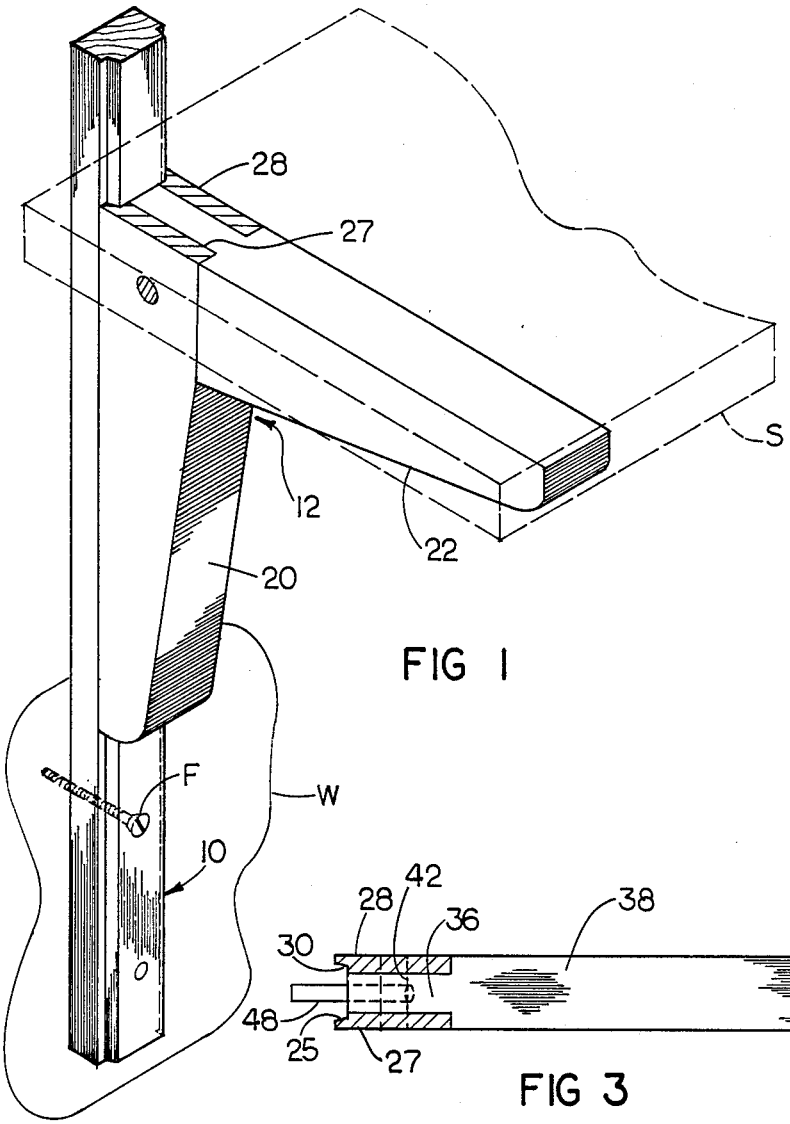
FIG. 1 is a perspective view of a preferred form of wall bracket assembly and specifically illustrating one side of a wall bracket assembly consisting of a standard and bracket member in accordance with the present invention.
Figure 3:
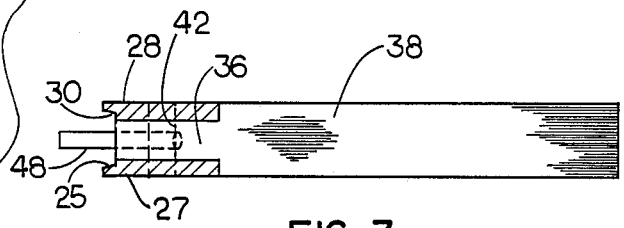
FIG. 3 is top plan view of the bracket portion shown in FIG. 1.
Figures 6, 7:
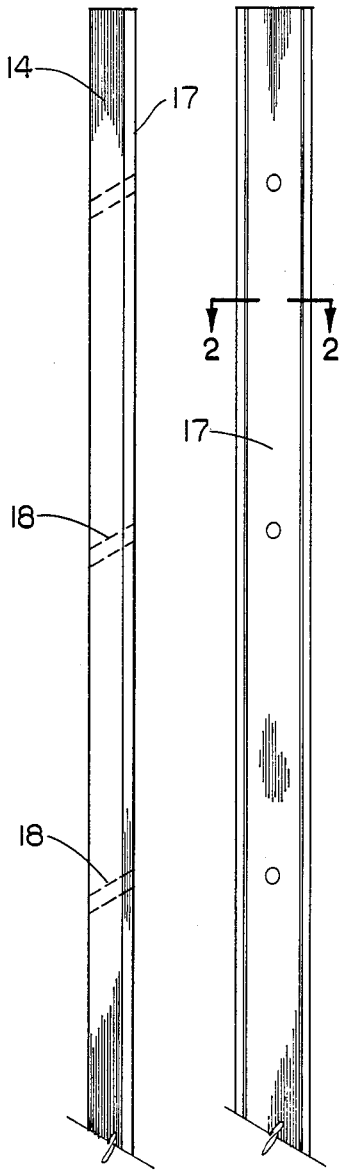
FIG. 6 is a side view of standard forming a part of the wall bracket assembly of the present invention.
FIG. 7 is a front view of the standard illustrated in FIGS. 1 and 6.
Figure 4:
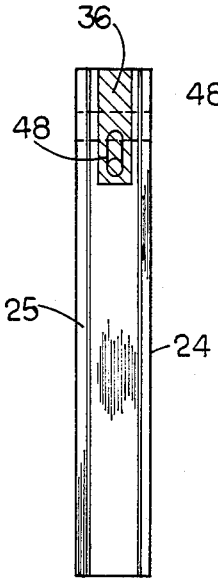
FIG. 4 is an end view of the preferred form of bracket member.
Figure 5:
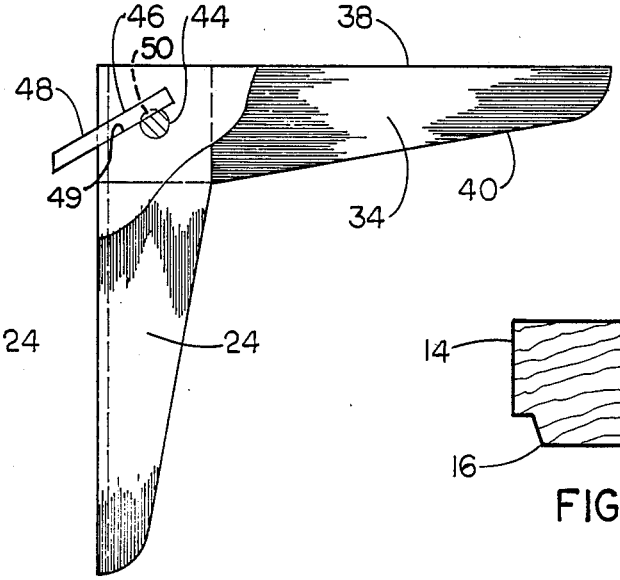
FIG. 5 is a side view of the preferred form of bracket member.
Figure 2:
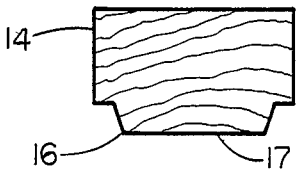
FIG. 2 is a top plan view of the standard shown in FIG. 1.

As illustrated in FIGS. 2, 6 and 7, the standard 10 is preferably an elongated slender board of generally rectangular cross-section having a thick body portion designated at 14 and a forwardly projecting coping 16 which converges away from the body and terminates in a flat vertical end surface 17. Bores 18 are arranged at vertically spaced intervals along the length of the standard 10 and, as noted, are angled downwardly and inwardly from the front end surface 17 through the thickness of the standard for the purpose of adjustably supporting a bracket member 12 in a manner to be described. The standard 10 is mounted on a wall surface by suitable fasteners F in a well-known manner.

The bracket member 12 is made up of a vertically extending bracket portion 20 and a horizontally extending bracket portion 22. Vertical bracket portion 20 is of solid construction having a main body 24, vertical edge portion 25 which has a detail complementary to the coping 16 on the standard and a first upper connecting end which is made up of spaced or bifurcated end portions 27, 28 which are flush with the opposite respective side surfaces of the main body 24. The bifurcated ends 27 and 28 form a common space or groove therebetween and the upper vertical edge 25 of the bracket portion 20 is defined by the bifurcated ends 27 and 28 which are beveled or sloped as at 30 so as to be complementary to the coping 16 on the standard as previously described.

The horizontal bracket portion 22 is of solid construction with a body portion 34 which tapers away from a connecting end portion 36, the portion 36 being of reduced thickness with respect to the thickness of the horizontal bracket portion to form an interfitting tongue which is dimensioned for close-fitting insertion between the ends 27 and 28. When inserted and connected to the vertical portion 20, the bracket portion 22 has an upper horizontal shelf supporting surface 38 and an upwardly and forwardly sloping surface 40. Aligned openings in the upper connecting ends 27, 28 and the connecting end 36 form a common transverse bore, designated at 42, for insertion of a cross pin 44. The cross pin 44 forms one element of a securing means between the complementary connecting ends, and a second element is defined by a dowel 46 which extends into engagement with the cross pin 44 through an angular bore 49 in the second connecting end portion 36, the dowel 46 angling downwardly and rearwardly as indicated at 48 for insertion into one of the openings 18 in the standard 17. Preferably, the dowel 46 is inserted through the bore 49 to bear against a grooved surface 50 located intermediately of the cross pin 44 so that the dowel 46 will retain the cross pin 44 securely within the bore 42 against accidental shifting or release.

When the bracket portions 20 and 22 are assembled together with the cross pin inserted through the common bore 42, the support pin 46 is then inserted upwardly through the bore in the second connecting end portion 36 until the upper end of the pin traverses the grooved portion 50 of the cross pin 44. A bonding agent may be placed or injected between the pins 44 and 46 or, if desired, the support pin 46 may be wedged or pressfit through the bore to permanently connect the portions 20 and 22. Projecting end 48 projects outwardly and downwardly at an angle corresponding to that of the bores 18. Thus, when the projecting end 48 is inserted into one of the bores, the vertical edge 25 will interfit with the coping 16. In fact, any weight placed on the bracket, such as, by a shelf or other articles will increase the pressure or force of engagement between the complementary detail and coping surfaces so as to discourage any tendency of the bracket to turn or twist with respect to the standard.

From the foregoing, completed wall bracket 12 is of rugged construction with the connecting end portions mutually reinforcing one another, and the support pin or dowel 48 being located and angled away from the connecting ends so as to cooperate with the vertical edge 25 in securely retaining the bracket in position against the standard. Although the preferred form of wall bracket assembly has been described as being of completely wooden construction, it will be apparent that other materials may be employed, such as, selected of the high strength plastic materials. Moreover, if desired, metal pins may be utilized in the construction of the cross pin 44 and dowel 48.

It is therefore to be understood that various modifications and changes may be made in the construction and arrangement of parts as well as the composition of materials making up the parts of the present invention without departing from the spirit and scope thereof as defined by the appended claims.

I claim:

1. A wall bracket assembly comprising in combination horizontally spaced standards provided with vertically spaced openings therein, fastener means for fastening said standards in horizontally spaced relation to one another on a common wall surface, a wall bracket for each standard, each wall bracket including a vertically extending portion with a first upper connecting end portion and a vertical edge engaging one of said standards, a horizontally extending bracket portion having an upper shelf support surface and a second connecting end complementary to said first connecting end, securing means interconnecting said first and second connecting ends together whereby to rigidly connect said horizontal bracket portion to said vertical bracket portion, and said means interconnecting said first and second connecting ends including a projection insertable into a selected opening in one of said standards, said first and second connecting ends having interfitting tongue and groove portions, and said securing means including a cross pin extending through aligned openings in said tongue and groove portions.

2. A wall bracket assembly according to claim 1, said projection engaging said cross pin and extending downwardly and rearwardly through said vertical edge of said vertically extending bracket portion for insertion into an opening in one of said standards.

3. A wall bracket assembly according to claim 2, said projection extending normal to and engageable with a grooved portion on said cross pin to anchor said cross pin in position within said aligned openings.

4. A wall bracket assembly according to claim 1, each said standard and bracket having interfitting detail and coping portions, respectively, said projection extending through said coping into one of said selected openings.

5. In a wall bracket assembly wherein a support member is provided with at least one opening therein, and a fastener for mounting said support member on a vertical wall surface, the combination therewith comprising:

a wall bracket having a vertically extending portion and a first upper connecting end portion, and a horizontally extending portion having an upper support surface and a second connecting end, complementary tongue and groove portions between said first and second connecting ends, a cross pin extending through aligned bores in said first and second connecting ends to rigidly connect said horizontal bracket portion in fixed relation to said vertical bracket portion, and a support pin wedged into engagement with said cross pin including a downwardly angled projection insertable into said opening in said wall support member.

6. In a wall bracket assembly according to claim 5, said first and second connecting ends having interfitting, complementary tongue and groove portions, and said cross pin extending through aligned bores in said tongue and groove portions, and said support pin engaging said cross pin and extending downwardly and rearwardly through said vertical edge of said vertically extending bracket portion for insertion into said opening.

7. In a wall bracket assembly according to claim 6, said support pin wedged in a grooved portion on said cross pin to anchor said cross pin in position within said aligned bores.

8. In a wall bracket assembly according to claim 5, said support member and said vertically extending portion of said bracket having complementary grooved and projecting portions therebetween.

* * * * *